US009024824B2

(12) United States Patent
Hsu et al.

(10) Patent No.: US 9,024,824 B2
(45) Date of Patent: May 5, 2015

(54) ANTENNA ASSEMBLY AND WIRELESS COMMUNICATION DEVICE EMPLOYING THE SAME

(75) Inventors: Cho-Kang Hsu, New Taipei (TW); Yi-Ting Chen, New Taipei (TW); Mei-Tsu Tsao, New Taipei (TW)

(73) Assignee: Chi Mei Communication Systems, Inc., New Taipei (TW)

( * ) Notice: Subject to any disclaimer, the term of this patent is extended or adjusted under 35 U.S.C. 154(b) by 617 days.

(21) Appl. No.: 13/298,399

(22) Filed: Nov. 17, 2011

(65) Prior Publication Data

US 2012/0249383 A1 Oct. 4, 2012

(30) Foreign Application Priority Data

Mar. 29, 2011 (TW) ..... 100110673 A

(51) Int. Cl.
*H01Q 1/24* (2006.01)
*H01Q 21/28* (2006.01)

(52) U.S. Cl.
CPC ..... *H01Q 1/243* (2013.01); *H01Q 21/28* (2013.01)

(58) Field of Classification Search
CPC ..... H01Q 1/241; H01Q 1/242; H01Q 1/2258
USPC ..... 343/702, 892
See application file for complete search history.

(56) References Cited

U.S. PATENT DOCUMENTS

2008/0074329 A1* 3/2008 Caballero et al. ..... 343/702
2008/0150811 A1* 6/2008 Honda et al. ..... 343/702
2012/0194393 A1* 8/2012 Uttermann et al. ..... 343/702

FOREIGN PATENT DOCUMENTS

CN 1893703 A 1/2007

* cited by examiner

*Primary Examiner* — Dieu H Duong
(74) *Attorney, Agent, or Firm* — Novak Druce Connolly Bove + Quigg LLP

(57) ABSTRACT

An antenna assembly is used in a wireless communication device, the wireless communication device includes a main body and a circuit board received within the main body. The antenna assembly includes a first antenna unit located in the main body, a feed point and a second antenna unit. The feed point is electrically connected to the circuit board and the first antenna unit. One part of the second antenna unit is exposed from the main body, the other part of the second antenna unit is located within the main body and produces resonance with the first antenna unit to receive and transmit radio signals. The antenna assembly can occupy small space in the wireless communication device and reduce coupled interference of other electronic components on the antenna assembly.

19 Claims, 2 Drawing Sheets

ANTENNA ASSEMBLY AND WIRELESS COMMUNICATION DEVICE EMPLOYING THE SAME

BACKGROUND

1. Technical Field

The disclosure generally relates to telecommunications, and more particularly to an antenna assembly and a wireless communication device employing the antenna assembly.

2. Description of the Related Art

Antennas are important components in wireless communication devices such as mobile phones or personal digital assistants (PDAs), for example, converting electric currents to radio waves, and receiving and transmitting the radio waves. However, most of the antennas have a large size and complex structures, which may occupy a large amount of inner space of the wireless communication devices which will not allow miniaturization of the wireless communication devices.

Therefore, there is room for improvement within the art.

BRIEF DESCRIPTION OF THE DRAWINGS

Many aspects of an antenna assembly and a wireless communication device employing the same can be better understood with reference to the following drawings. The components in the drawings are not necessarily drawn to scale, the emphasis instead being placed upon clearly illustrating the principles of the antenna assembly and wireless communication device method employing the same. Moreover, in the drawings, like reference numerals designate corresponding parts throughout the several views. Wherever possible, the same reference numbers are used throughout the drawings to refer to the same or like elements of an embodiment.

DETAILED DESCRIPTION

Figure 1:
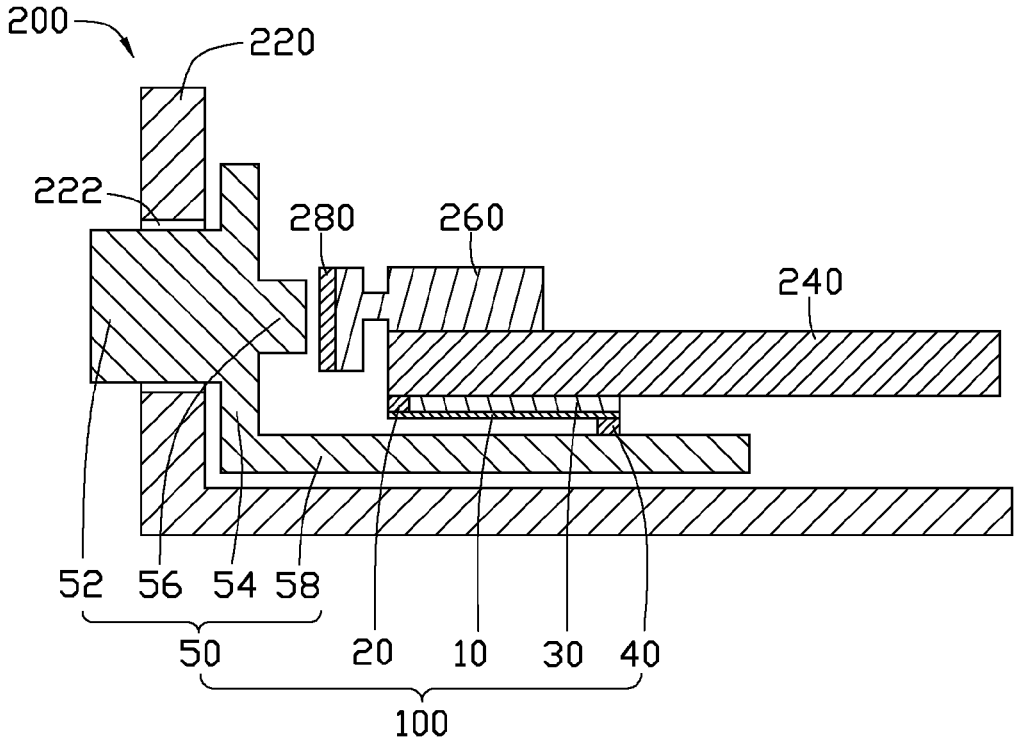
FIG. 1 is a partial cross-sectional view of a wireless communication device including a circuit board and an antenna assembly, according to an embodiment of the disclosure.
Figure 2:
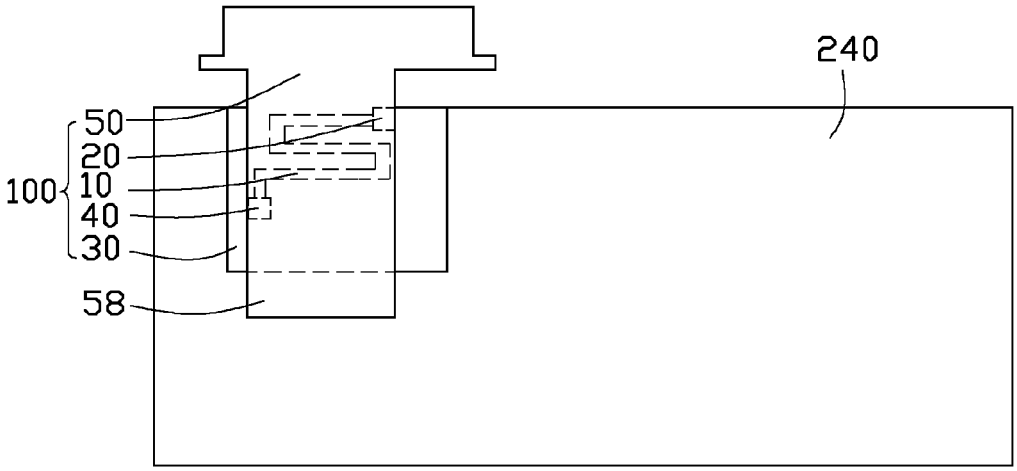
FIG. 2 is a schematic view of the antenna assembly connected to the circuit board shown in FIG. 1 of the disclosure.

FIG. 1 is a partially cross-sectional view of a wireless communication device 200 including a circuit board 240 and an antenna assembly 100, according to an embodiment of the disclosure. In this embodiment, the wireless communication device 200 can be a mobile phone or a personal digital assistant (PDA), for example, and further includes a main body 220 and a function selection module 260. The circuit board 240 and the function selection module 260 are assembled within the main body 220.

In this embodiment, the main body 220 defines an opening 222. The circuit board 240 can be a printed circuit board (PCB) and includes a signal incepting point (not shown), the signal incepting point is used to provide and transmit radio signals to the antenna assembly 100. The function selection module 260 is electrically located on the circuit board 240, and can be directly manipulated by a user to break an electrical circuit or control power flow in a circuit of the wireless communication device 200. In this embodiment, the function selection module 260 can be a power switch of the wireless communication device 200 that executes different programs to turn on or turn off the wireless communication device 200.

In this embodiment, the antenna assembly 100 is integrated within the wireless communication device 100, and receives and transmits radio signals at a global positioning system (GPS) band. The antenna assembly 100 includes a first antenna unit 10, a feed point 20, a bracket 30, a connection portion 40, and a second antenna unit 50. The first antenna unit 10 is made of conductive materials such as copper or other metals, and is located within the main body 220. In this embodiment, the first antenna unit 10 is a substantially square-wave shaped plate and is substantially parallel to the circuit board 240.

The feed point 20 is located at one distal end of the first antenna unit 10 and is electrically connected to the signal incepting point of the circuit board 240, to deliver and transmit the radio signals to the first antenna unit 10. In this embodiment, the bracket 30 is made of non-conductive materials and is positioned between the circuit board 240 and the first antenna unit 10, to support and carry the first antenna unit 10. The connection portion 40 is located at another distal end of the first antenna unit 10 opposite to the feed point 20. The connection portion 40 elastically resists against the second antenna unit 50 to connect the first antenna unit 10 and the second antenna unit 50. The connection portion 40 can be an elastic metal sheet.

In this embodiment, the second antenna unit 50 can be made of copper, or other metal, or electroplated plastic that has the capacity of radiating electromagnetic waves. The second antenna unit 50 is partially exposed to the main body 220 and may be used as a power button of the wireless communication device 200, for example. The second antenna unit 50 includes a first radiating section 52, a second radiating section 54, a third radiating section 56, and a fourth radiating section 58.

The first radiating section 52 is substantially rectangular shape, and passes through the opening 222, and is partially exposed to the main body 220, which may save the inner design space of the wireless communication device 200. The second radiating section 54 is substantially rectangular shape, and is located within the main body 220. The size of the second radiation section 54 is substantially larger than that of the opening 222 to prevent the second antenna unit 50 moving out from the opening 222. The third radiating section 56 and the first radiating section 52 are located at opposite sides of the second radiating section 54. The third radiating section 56 is aligned with the function selection module 260 to selectably contact and resist against the function selection module 260 to execute different functions.

In this embodiment, the first radiating section 52, the second radiating section 54 and the third radiating section 56 are implemented as the power button. When the first radiating section 52 is operated, the second radiating section 54 elastically deforms, and the third radiating section 56 moves towards the function selection module 260 until the third radiating section 56 contacts and resists against the function selection module 260. Thus, the function selection module 200 can execute different programs to turn on or turn off the wireless communication device 200. In this embodiment, an insulation layer 280 is positioned on the function selection module 260 to prevent short circuit when the third radiating section 56 contacts the function selection module 260.

The fourth radiating section 58 is electrically connected to the second radiating section 54, and is located within the main body 220, and extends towards the first antenna unit 10, and is electrically connected to the first antenna unit 10 through the connection portion 40. Thus, a current path is formed on the second antenna unit 50 and the first antenna unit 10 via the connection portion 40, therefore, the first antenna unit 50 and the second antenna unit 50 can produce resonance at the GPS frequency band.

In use, the signal incepting point of circuit board 240 provides an oscillating radio frequency electric current for the first antenna unit 10 and the second antenna unit 50 to radiate the energy from the current as electromagnetic waves (radio waves) to send the GPS signals. Referring to following comparison table, where the comparison table illustrates efficiency relationship between the antenna assembly 100 of the disclosure and a traditional built-in antenna.

| | Antenna Efficiency (%) | | |
|---|---|---|---|
| Frequency (MHz) | The traditional built-in antenna | The antenna assembly | Value increased |
| 1525 | 12.2 | 21.6 | 9.5 |
| 1550 | 17.4 | 28.4 | 11. |
| 1575 | 23.0 | 39.1 | 16.1 |
| 1600 | 20.9 | 33.7 | 12.8 |
| 1625 | 16.3 | 23.1 | 6.8 |

In addition to receiving and transmitting the GPS signals, the antenna assembly 100 can also receive and transmit other radio signals, such as BLUETOOTH signals or WIFI signals. Moreover, the first radiating section 52, the second radiating section 54 and the third radiating section 56 of the second antenna unit 50 can also be applied as volume adjustment button or can be used for other functions, but not limited to the power button.

In summary, the antenna assembly 100 of the disclosure, the second antenna unit 50 is partially exposed to the main body 220 to be implemented as a function button, such as a power switch or volume adjustment button, which can occupy small space of the wireless communication device 200 and reduce coupled interference of other electronic components on the antenna assembly 100. Moreover, the other part of the second antenna unit 50 is located within the main body 220, and resonates with first antenna unit 10 to produce corresponding resonant frequencies.

In the present specification and claims, the word "a" or "an" preceding an element does not exclude the presence of a plurality of such elements. Further, the word "comprising" does not exclude the presence of other elements or steps than those listed.

It is to be understood, however, that even though numerous characteristics and advantages of the exemplary disclosure have been set forth in the foregoing description, together with details of the structure and function of the exemplary disclosure, the disclosure is illustrative only, and changes may be made in detail, especially in matters of shape, size, and arrangement of parts within the principles of exemplary disclosure to the full extent indicated by the broad general meaning of the terms in which the appended claims are expressed.

What is claimed is:

1. An antenna assembly used in a wireless communication device that comprises a main body and a circuit board received within the main body, the antenna assembly comprising:

a first antenna unit located in the main body;

a feed point located on the first antenna unit and electrically connected to the circuit board; and a second antenna unit electrically connected to the first antenna unit, wherein the second antenna unit comprises a first radiating section, a second radiating section, and a third radiating section, the third radiating section and the first radiating section are located at opposite sides of the second radiating section, the first radiating section is partially exposed to the main body, the other part of the first radiating section, the second radiating section, and the third radiating section are located within the main body and produce resonance with the first antenna unit to receive and transmit radio signals.

2. The antenna assembly as claimed in claim 1, further comprising a bracket made of non-conductive materials, wherein the bracket is positioned between the circuit board and the first antenna unit to support and carry the first antenna unit.

3. The antenna assembly as claimed in claim 1, further comprising a connection portion located at one end of the first antenna unit, wherein the connection portion is an elastic metal sheet and elastically resists against the second antenna unit to connect the first antenna unit and the second antenna unit.

4. The antenna assembly as claimed in claim 3, wherein the feed point is located at the other end of the first antenna opposite to the connection portion, and receives and sends the radio signals to the first antenna unit.

5. The antenna assembly as claimed in claim 3, wherein the second antenna unit further comprises a fourth radiating section electrically connected to the second radiating section, the fourth radiating section is located within the main body, and extends towards the first antenna unit and is electrically connected to the first antenna unit through the connection portion, and the first antenna unit and the second antenna unit produce resonance.

6. The antenna assembly as claimed in claim 1, wherein the first antenna unit is made of conductive materials, the first antenna unit is a substantially square-wave shaped plate and is substantially parallel to the circuit board.

7. The antenna assembly as claimed in claim 1, wherein the first radiating section, the second radiating section and the third radiating section together are implemented as a power button, when the first radiating section is operated, the second radiating section elastically deforms, the third radiating section moves until contacting and resisting against a function selection module of the wireless communication device to execute different functions of the wireless communication device.

8. The antenna assembly as claimed in claim 1, wherein the second antenna unit is made of copper, or electroplated plastic that has the capacity of radiating electromagnetic waves.

9. A wireless communication device comprising:

a main body;

a circuit board received within the main body;

an antenna assembly electrically connected to the circuit board, the antenna assembly comprising:

a first antenna unit located within the main body for receiving and transmitting radio signals;

a feed point electrically connected to the first antenna unit and the circuit board; and a second antenna unit electrically connected to the first antenna unit, wherein the second antenna unit comprises a first radiating section, a second radiating section, and a third radiating section, the third radiating section and the first radiating section are located at opposite sides of the second radiating section, the first radiating section is partially exposed to the main body, the other part of the first radiating section, the second radiating section, and the third radiating section are received within the main body, and resonate with the first antenna unit to produce resonant frequencies to receive and transmit the radio signals.

10. The wireless communication device as claimed in claim 9, wherein the antenna assembly further comprises a bracket, the bracket is made of non-conductive materials, and is positioned between the circuit board and the first antenna unit to support and carry the first antenna unit.

11. The wireless communication device as claimed in claim 9, wherein the antenna assembly further comprises a connection portion located at one end of the first antenna unit, the connection portion is an elastic metal sheet and elastically resists against the second antenna unit to connect the first antenna unit and the second antenna unit.

12. The wireless communication device as claimed in claim 11, wherein the feed point is located at the other end of the first antenna opposite to the connection portion, and receives and sends the radio signals to the first antenna unit.

13. The wireless communication device as claimed in claim 11, further comprising a function selection module received within the main body, the function selection module is electrically located on the circuit board, and can is directly manipulated to break an electrical circuit or control power flow in a circuit of the wireless communication device to execute different programs to turn on or turn off the wireless communication device.

14. The wireless communication device as claimed in claim 13, wherein the third radiating section is aligned with the function selection module to selectably resist against and contact the function selection module to execute different functions.

15. The wireless communication device as claimed in claim 13, wherein the first radiating section, the second radiating section and the third radiating section together are implemented as a power button, when the first radiating section is operated, the second radiating section elastically deforms, the third radiating section moves towards the function selection module until the third radiating section contacts the function selection module to execute different functions of the wireless communication device.

16. The wireless communication device as claimed in claim 11, wherein the second antenna unit further comprises a fourth radiating section electrically connected to the second radiating section, the fourth radiating section is located within the main body, and extends towards the first antenna unit and is electrically connected to the first antenna unit through the connection portion, and the first antenna unit and the second antenna unit produce resonance.

17. The wireless communication device as claimed in claim 9, wherein the first antenna unit is made of conductive materials, the first antenna unit is a substantially square-wave shaped plate and is substantially parallel to the circuit board.

18. The wireless communication device as claimed in claim 9, wherein the second antenna unit is made of copper, or electroplated plastic that has the capacity of radiating electromagnetic waves.

19. An antenna assembly used in a wireless communication device that comprises a main body and a circuit board received within the main body, the antenna assembly comprising:

a first antenna unit located in the main body;

a feed point located on the first antenna unit and electrically connected to the circuit board; and a second antenna unit electrically connected to the first antenna unit, wherein the second antenna unit comprises a first radiating section, a second radiating section, and a third radiating section, the first radiating section, the second radiating section, and the third radiating section together are implemented as a power button for selectably contacting and resisting against a function selection module of the wireless communication device to execute different functions of the wireless communication device, the first radiating section is partially exposed to the main body, the other part of the first radiating section, the second radiating section, and the third radiating section are located within the main body, the third radiating section and the first radiating section are located at opposite sides of the second radiating section and produce resonance with the first antenna unit to receive and transmit radio signals.

* * * * *